United States Patent [19]

Graffis et al.

[11] 4,345,998

[45] Aug. 24, 1982

[54] PLASTIC CATCH BASIN

[76] Inventors: Kelly R. Graffis, 20209 Broadway, Snohomish, Wash. 98290; Bruce G. Sievert, 18519 - 43rd Pl., Lynnwood, Wash. 99036

[21] Appl. No.: 203,268

[22] Filed: Nov. 3, 1980

Related U.S. Application Data

[63] Continuation of Ser. No. 55,179, Jul. 5, 1979, abandoned.

[51] Int. Cl.[3] ..... E01F 5/00; E03F 5/06

[52] U.S. Cl. ..... 210/164; 210/532.1; 404/4

[58] Field of Search ..... 210/163, 164, 532 S, 210/165, 166; 52/19–21; 404/2–5

[56] References Cited

U.S. PATENT DOCUMENTS

| | | | |
|---|---|---|---|
| Re. 26,366 | 4/1968 | Flegel | 404/2 |
| 2,701,027 | 2/1955 | Scoville | 210/163 |
| 2,993,600 | 7/1961 | Resslor | 210/164 |
| 3,221,881 | 12/1965 | Weiler et al. | 210/532 S |
| 3,426,903 | 2/1969 | Olecko | 210/232 |
| 3,670,894 | 6/1972 | Friedl | 210/164 |
| 3,672,103 | 6/1972 | Kost | 52/20 |
| 3,897,090 | 7/1975 | Maroschak | 285/DIG. 4 |
| 3,974,599 | 8/1976 | Grosh | 52/20 |
| 4,045,346 | 8/1977 | Swaskey | 210/164 |
| 4,061,368 | 12/1977 | Auriemma | 285/DIG. 4 |
| 4,263,138 | 4/1981 | Kessel | 210/163 |
| 4,273,466 | 6/1981 | Trahan, Sr. et al. | 210/163 X |

FOREIGN PATENT DOCUMENTS

| | | | |
|---|---|---|---|
| 2456169 | 1/1981 | France | 404/4 |
| 1208833 | 10/1970 | United Kingdom | 210/163 |

*Primary Examiner*—Robert H. Spitzer
*Attorney, Agent, or Firm*—Delbert J. Barnard; Eugene O. Heberer; Joan H. Pauly

[57] ABSTRACT

A molded structural plastic grate is received within a recess defined by a rim at the top of a structural plastic catch basin which also serves as a girth beam for strengthening the top of the basin. Bottom portions of the basin are rounded to provide a dome section for strengthening the bottom of the basin. The four corners of the basin reinforce it against buckling under weight placed on top of it. Each side wall of the basin is formed to include a breakout section adapted to be easily removed to provide a drain pipe receiving opening. The portion of the side wall surrounding the opening is adapted to be received within a groove portion of a section of corrugated plastic pipe.

9 Claims, 8 Drawing Figures

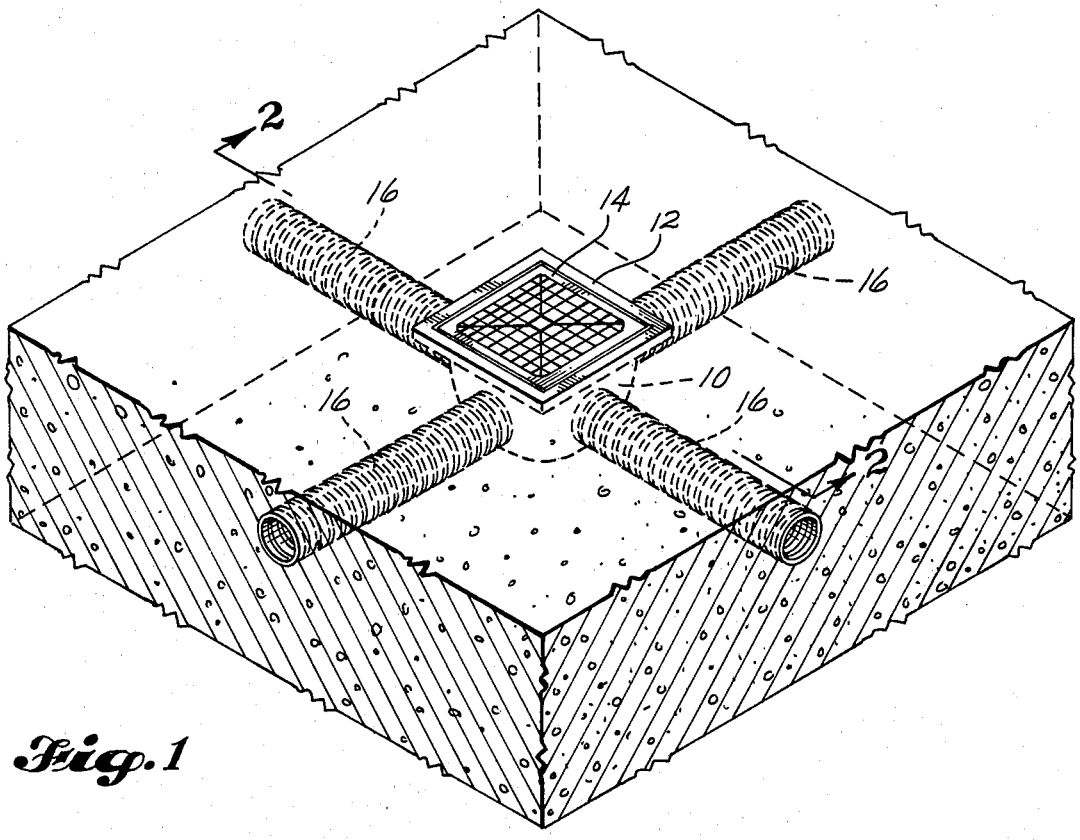
Fig. 1
Fig. 2
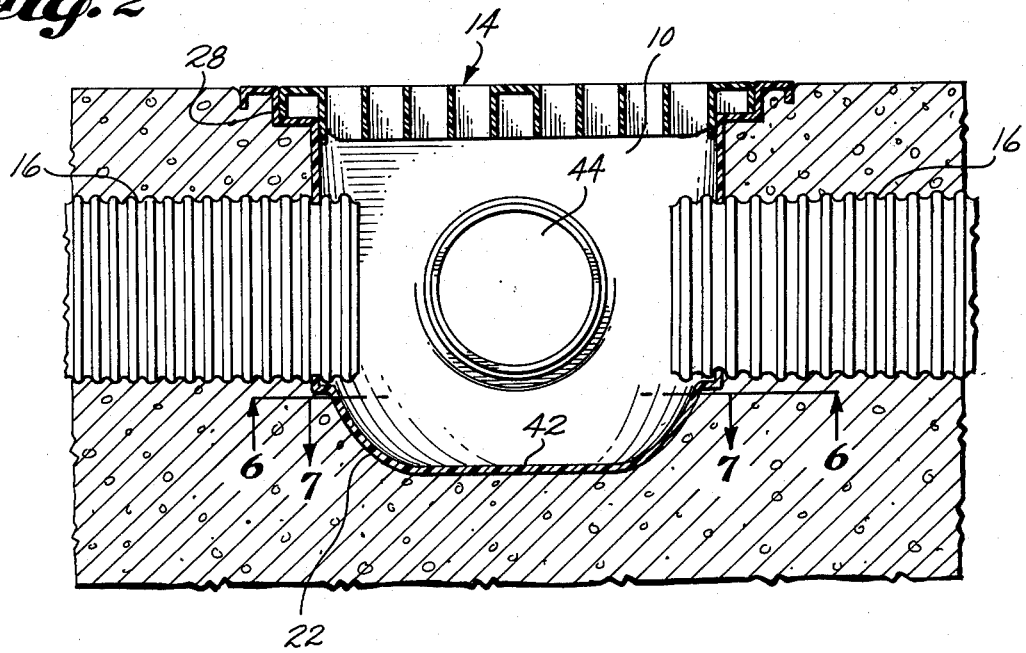

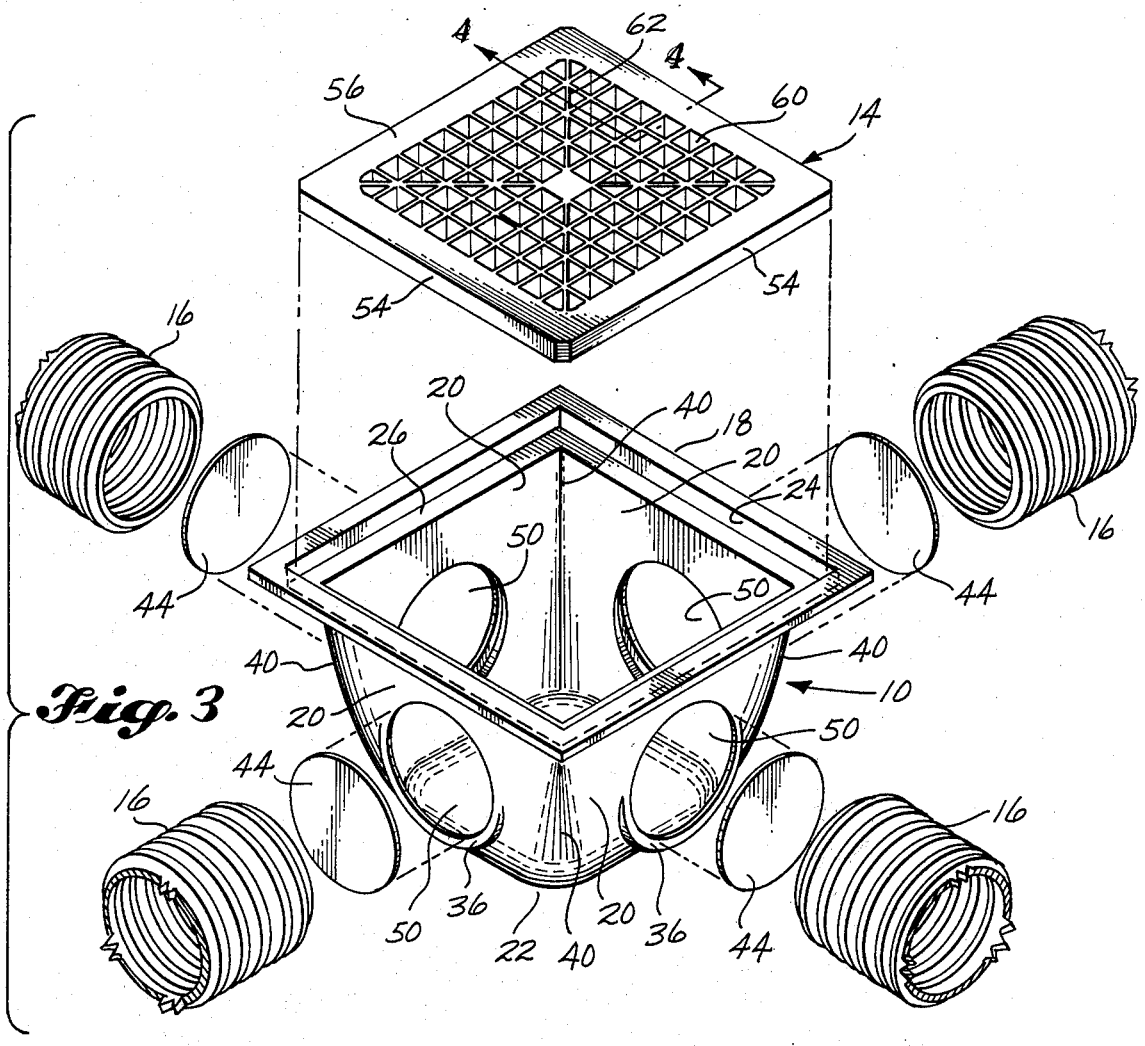
Fig. 3
Fig. 4
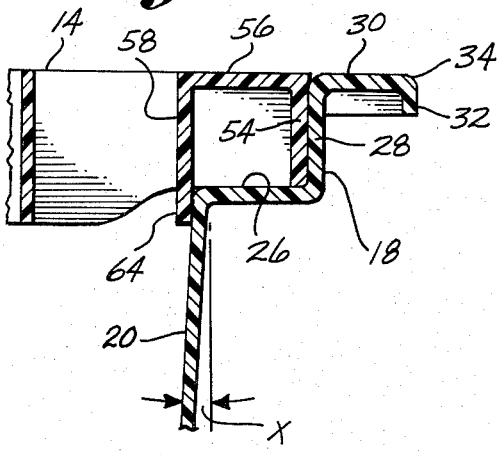
Fig. 5
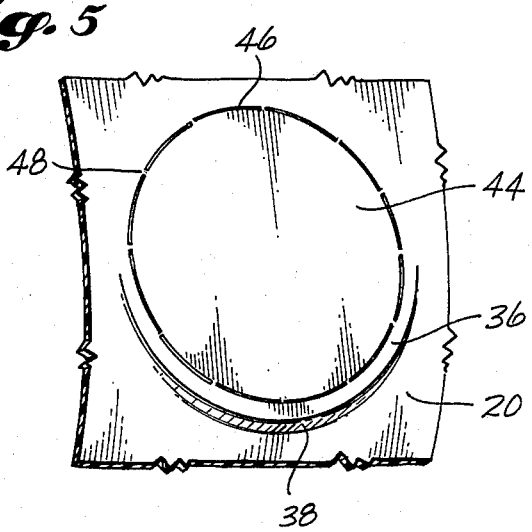

PLASTIC CATCH BASIN

This is a continuation, of application Ser. No. 55,179, filed July 5, 1979, now abandoned.

BACKGROUND OF THE INVENTION

1. Field of the Invention

The present invention relates to receptacles termed "catch basins" which are adapted to be implanted in the ground for catching rain or surface water and which are further adapted to be connected to an underground drainage pipe which carries the water away from the basin. More specifically, it relates to the provision of a new, lightweight but strong catch basin assembly which is constructed from a structural plastic material and which is adapted to be firmly connected to corrugated plastic drain pipe which is in wide use today.

2. Description of the Prior Art

Catch basins have for many years been constructed from concrete, in the form of hollow rectangular or slightly tapering boxes having an open top adapted to receive a metal grate. Such catch basins are cast to include a thin circular section of concrete on at least some of their sides which may be easily broken out to provide a hole for receiving an end portion of a drain pipe.

A concrete catch basin has several disadvantages. Firstly, they are relatively heavy and they cannot be stacked together. For this reason they are relatively expensive to transport, particularly over long distances. Also, corrugated plastic drain pipe has for the most part replaced concrete pipe for use in drain fields and it is quite difficult to connect plastic drain pipe to concrete catch basins.

It is an object of the present invention to provide a structural plastic catch basin which is light weight but yet owing to its construction is quite strong and readily stackable with others, making it feasible to economically transport a large number of such catch basins over considerable distances.

SUMMARY OF THE INVENTION

According to the present invention, the catch basin comprises four side walls meeting at four corners, a bottom, and a top rim formed to include an upwardly opening grate receiving recess. The top rim extends about the catch basin and comprises a shelf portion which is a horizontal continuation of the side walls of the catch basin, and a vertical wall portion which is an upward continuation of said horizontal shelf portion. Each side wall comprises a main panel portion which slopes inwardly as it extends downwardly. The corners of the basin change gradually from a small radius, substantially square configuration at the rim to a flatter, substantially wider, e.g. rounded configuration at the bottom. Each side wall includes a generally upright central portion and a transition wall interconnecting the lower part of such central portion with the lower adjoining part of the main panel portion of the side wall. The top rim serves as both a receptacle for a grate and a structural girth beam for strengthening the top of the catch basin. The changing shape of the basin at the bottom provides dome strength at the bottom of the basin. The corners of the basin and the transition walls reinforce the catch basin vertically against buckling under weight place on top of the catch basin.

According to an aspect of the invention, the rim of the catch basin may include a dirt plate in the form of a horizontal outward continuation of the vertical wall portion of the rim. The dirt plate is provided to help keep dirt in which the catch basin is implanted from migrating into the grate receiving recess.

According to another aspect of the invention, the rim includes a peripheral lip in the form of a continuation of the dirt plate, extending vertically downwardly from the outer boundaries of the dirt plate.

According to still another aspect of the invention, the central portion of at least one of the side walls includes a drain pipe receiving opening which is bordered all around by thin plastic material sized to snugly fit within grooved portions of corrugated plastic drain pipe. The catch basin may be formed to include a breakout type closure for each such hole which is a part of the central portion of the side wall and that is connected thereto by bridges of the wall material left between circumferentially spaced apart cuts formed in the wall material.

According to an important aspect of the invention, the side walls of the catch basin are adapted to permit a section of corrugated plastic drain pipe to be "snapped" into engagement with a side wall of the catch basin. To effect such installation a section of the corrugated plastic drain pipe is brought into register with the side wall opening. It is turned at an angle so that a portion of the first groove will engage a portion of the side wall material which immediately borders the opening. then, the pipe is both swung into alignment with the opening and moved endwise so that the rib that is immediately axially inward of such first groove will distort the side wall enough to allow the rib to pass through the opening. This procedure is continued until the pipe is firmly connected to the catch basin and the wall material is located in one of the grooves between two ribs.

Additional important features of the invention are described below in the description of the preferred embodiment and typical installations involving it.

BRIEF DESCRIPTION OF DRAWING FIGURES

FIG. 1 is an isometric view of a catch basin constructed according to the present invention, shown installed in the ground and connected to four drain ducts;

FIG. 2 is a sectional view taken substantially along line 2—2 of FIG. 1, showing the drain ducts in elevation;

FIG. 3 is an exploded isometric view of the catch basin, with all four hole covers removed;

FIG. 4 is a fragmentary sectional view taken substantially along line 4—4 of FIG. 3, but with the grate installed on the catch basin;

FIG. 5 is a fragmentary pictorial view in the region of a hole cover which is still connected to its side wall of the catch basin;

DESCRIPTION OF THE PREFERRED EMBODIMENT

Figure 6:
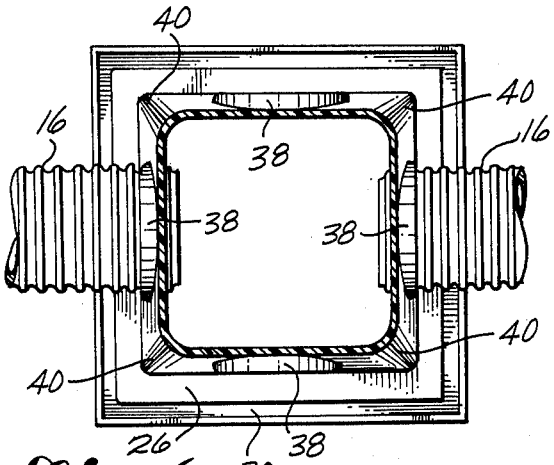
FIG. 6 is a cross-sectional view looking up, taken substantially along line 6—6 of FIG. 2.

Referring first to FIG. 1, a structural plastic catch basin 10 constructed according to the present invention is shown implanted in the ground with its top surface 12 and the top of a grate 14 generally flush with the surface of the ground.

The installation shown by FIG. 1 includes four drain pipes 16, one leading out from each of the four sides of the catch basin 10. This was done for illustration purposes only. A more typical installation would include less than four drain pipes.

As best shown by FIGS. 2, 3, 6 and 7, the catch basin 10 includes a top rim 18, four side walls 20 and a bottom 22.

The top rim 18 is formed to include an upwardly opening grate receiving recess 24. The top rim 18 extends entirely about the top of the catch basin 10 and comprises a shelf portion 26 which is a horizontal continuation of the tops of the side walls 20. It also includes a vertical wall portion 28 which is an upward continuation of the shelf portion 26. It may further comprise a dirt plate 30 in the form of a horizontal outward continuation of the vertical wall portion 28 and a peripheral lip 32 in the form of a downward continuation of the dirt plate 30. The dirt plate 30 helps to keep dirt in which the catch basin is implanted from migrating into the recess 24. The lip 32 helps to define a rounded corner 34, adding to the strength and appearance of the top of the catch basin, and may also help to anchor the catch basin 10 in place within the ground.

Each side wall 20 comprises a main panel portion which slopes inwardly as it extends downwardly. This is probably best shown by FIGS. 3, 4, and 6. As shown by FIG. 4, the slope angle X of the side wall 20 may be about three degrees (3°).

Each side wall 20 includes a central portion 36 and an arcuate transition wall 38 interconnected between the rounded lower boundary of such central portion 36 and the immediately adjacent portion of the main panel.

Figure 7:
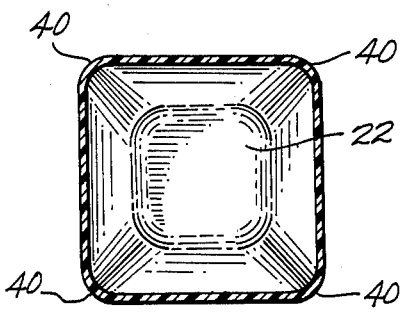
FIG. 7 is a cross-sectional view looking down, taken substantially along line 7—7 of FIG. 2.

As best shown by FIGS. 3, 6 and 7, the four corners 40 of the catch basin 10 change in shape gradually from a small radius substantially square configuration at the base of the rim 18 to a larger radius rounded configuration at the bottom 22. As shown by FIG. 2, the bottom portion 22 is rounded vertically as well as horizontally, to give such bottom dome strength. The illustrated embodiment is shown to include a flat bottom wall 42. However, if the rounded portions of the bottom were continued downwardly they would meet and provide the catch basin with a rounded shape of near spherical curvature.

The top rim 18 serves as both a receptacle for grate 14 and a structural girth beam for strengthening the top of basin 10. Basin 10 is constructed from relatively thin plastic material. However, the generally right angle interconnection of portions 26, 28, 30, 32 of the rim makes the rim a relatively rigid structure in all directions. The rounded nature of the corners of the catch basin at the bottom provide dome strength at the bottom which has a similar effect of making the bottom portion of the catch basin 10 rigid and not easily distortable. The four corners 40 of the catch basin, and to some extent the transition walls 38, reinforce the catch basin against buckling under weight placed on top of the catch basin 10.

The catch basin 10 may be either draw formed or injection molded. An advantage of injection molding would be that the wall thickness could be better controlled, e.g. made uniform throughout. Draw forming causes a thinning of the wall material in the lower portion of the catch basin 10. However, the rounded nature of the bottom 22 and the corners 40 provide adequate strengthening to even a draw formed catch basin 10 having a thinned lower portion. Each side wall 20 is constructed to initially include a breakout type closure or plug 44 defined by a circular series of cuts 46 separated by bridges 48 of side wall material. As best shown by FIG. 5, the cuts 46 extend all the way through the side wall and may be arcuate in shape and the bridges 48 may each be relatively narrow. The circle on which the cuts 46 lie is spaced above the transition wall 38 a sufficient distance to provide a thin panel portion of the side wall completely about the circle. This is done intentionally to facilitate connection of a section of drain pipe 16 to the catch basin 10.

Corrugated plastic drain pipe or tile is commonplace today. The corrugations strengthen the pipe which is itself constructed from relatively thin-walled plastic material and would readily flatten under weight placed on it if it did not include the corrugations.

As illustrated, the corrugations of the drain pipe 16 are defined by axially spaced apart ribs and grooves between the ribs. The opening defined by breaking out closure 44 is slightly larger in diameter than a groove region of drain pipe 16 and substantially smaller in diameter than a rib region.

Prior to installation of a catch basin 10, the prerequisite number of drain pipe receiving openings 50 are prepared by the installer knocking out or cutting out the closure plugs 44. Then a section of drain pipe 16 is brought into register with its opening 50 and is tilted to engage a portion of a groove with a portion of the side wall material which immediately surrounds the opening 50. Then, the pipe 16 is in effect "snapped" into placed. It was found that when such a section of corrugated pipe 16 was held at an angle to the hole 50, with a groove portion thereof engaging a portion of the side wall material, such drain pipe 16 can be rotated and forced endwise towards the catch basin 10 and the ribs will distort the side wall material enough to transfer such side wall material from groove to groove. FIG. 2 illustrates a typical installation in which the side wall material immediately bordering an opening 50 is located within the second groove in from the end of the pipe, between the two ribs on opposite sides of such groove.

As earlier explained, the main panel portion of each side wall 20 slopes inwardly from top to bottom. This helps establish a frictional grip between the side wall portion of the catch basin 10 and the corrugations of the drain pipe 16, providing a positive lock, whereby the drain pipes 16 may help anchor the catch basin 10 in place within the ground. An installation such as the one illustrated by FIG. 1, for example, is very stable. When the installation is backfilled, i.e. when dirt is placed over the drain pipe 16 and about the catch basin 10, the drain pipes 16 are fixed in position within the ground. The positive lock between them and the side wall portions of the catch basin 10 serve to hold the catch basin 10 firmly in position as well.

The grate 14 is preferably molded from a structural plastic as well. As best shown by FIGS. 2, 3, and 4, it preferably comprises a vertical outside peripheral wall 54 which extends completely about the grate 14, a horizontal peripheral top wall 56, and a vertical inner peripheral wall 58 which also extends completely about the grate 14. A rectangular grid 60 of webs is located in the span or central region inside of inner wall 58 and it may be strengthened by diagonal webs 62.

As shown by FIG. 4, the grate 14 is so constructed and sized that when it is set down into the recess 24 its peripheral portion rests on the shelf 26 and its top wall 56 is substantially flush with the top surface 12 of dirt plate 30. Also, its vertical outside wall 54 is adjacent vertical rim wall 28 and a lower portion 64 of its inner vertical wall 58 extends downwardly into basin 10 into a position adjacent the uppermost portions of the side walls 20. This arrangement helps the grate 14 and the rim 18 mutually brace each other when weight is placed on top of the assembly. In some installations the fit between the grate 14 and the rim may be a friction fit so that the bracing is enhanced and the use of fasteners is unnecessary.

Figure 8:
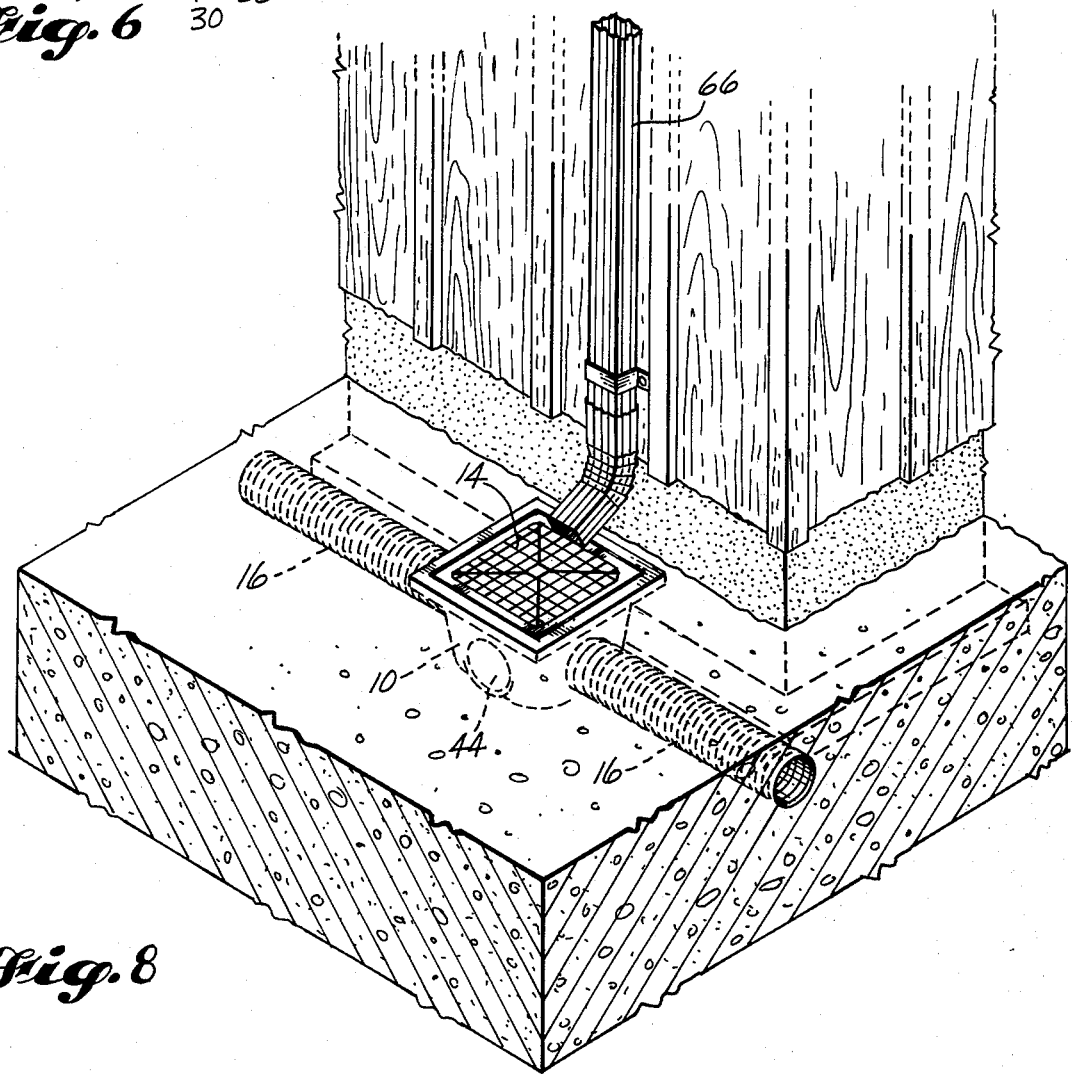
FIG. 8 is an isometric view of a catch basin installed adjacent a side of a building, below a downspout outlet.

FIG. 8 shows a more typical installation in which the catch basin is implanted in the ground below the outlet of a downspout 66 and the catch basin 10 is connected in series with a drain pipe which interconnects a plurality of catch basins 10.

Any of the known types of structural plastic materials may be used for constructing the catch basin 10 and the grate 14, e.g., polyethylene plastic. Of course, as new structural plastic materials are developed, they also may be used.

It is to be understood that many modifications can be made to the specific embodiment described above without departing from the scope of invention as defined in the claims which follow. For example, the basin may be used as a housing for an underground meter or faucet. The hole may be provided in bottom wall 42 and the grate may be replaced by a solid lid. Also, the corners may be flat, giving the lower portion of the basin an eight sided configuration, providing dome strength in this manner.

What is claimed is:

1. A thin-wall, monolithic, structural plastic catch basin comprising four side walls meeting at four corners, a bottom, and a top rim formed to include an upwardly opening grate receiving recess;

said top rim extending all the way around said catch basin and comprising a shelf portion which is a horizontal continuation of the side walls of the catch basin and a vertical wall portion which is an upward continuation of said horizontal shelf portion;

a thin-wall, horizontal plate, constituting an outward continuation of the vertical wall portion of the top rim, including a ground material contacting lower surface;

each said side wall comprising a main panel portion which slopes inwardly as it extends downwardly;

said corners changing gradually in shape, from a small radius, substantially square configuration at the rim to a flatter, substantially wider configuration at the bottom;

each side wall including a generally upright central portion and a crescent shape transition wall interconnected between the lower part of said central portion and the adjoining part of the main panel portion of the side wall;

with said top rim serving as both a receptacle for a grate and as a structural girth beam which strengthens the top of the catch basin;

with the changing shape of the corners of the catch basin at the bottom providing a substantially dome shape attended by dome strength at the bottom of the catch basin; and with the corners of the catch basin and the transition walls reinforcing the catch basin vertically against buckling under weight placed on the top of the catch basin.

2. A catch basin according to claim 1, wherein the central portion of at least one of the side walls includes a drain pipe receiving opening which is bordered all the way around by thin-wall plastic material sized to fit within grooved portions of corrugated plastic drain pipe.

3. A plastic catch basin according to claim 2, wherein said catch basin is formed to include a breakout closure for such opening which is formed as a part of the central portion of the side wall and is connected thereto by bridges of the wall material left between circumferentially spaced apart cuts formed in the wall material.

4. A thin-wall, monolithic, structural plastic catch basin comprising four side walls meeting at four corners, a bottom, and a top rim formed to include an upwardly opening grate receiving recess;

said top rim extending all the way around said catch basin and comprising a shelf portion which is a horizontal continuation of the side walls of the catch basin and a vertical wall portion which is an upward continuation of said horizontal shelf portion;

a thin-wall, horizontal plate, constituting an outward continuation of the vertical wall portion of the top rim, including a ground material contacting lower surface;

each said side wall comprising a main panel portion which slopes inwardly as it extends downwardly;

said corners changing gradually in shape, from a small radius, substantially square configuration at the rim to a flatter, substantially wider configuration at the bottom;

each side wall including a generally upright central portion and a crescent shape transition wall interconnected between the lower part of said central portion and the adjoining part of the main panel portion of the side wall;

with said top rim serving as both a receptacle for a grate and as a structural girth beam which strengthens the top of the catch basin;

with the changing shape of the corners of the catch basin at the bottom providing a substantially dome shape attended by dome strength at the bottom of the catch basin;

with the corners of the catch basin and the transition walls reinforcing the catch basin vertically against buckling under weight placed on the top of the catch basin; and a grate sized to fit within said grate receiving recess, said grate having an outer side portion which is locatable adjacent the vertical wall portion of said rim, and means spaced inwardly from said outer side portion which extends downwardly into the catch basin below said horizontal shelf portion into a bracing position adjacent upper inside surface portions of the side walls of the catch basin.

5. A plastic catch basin according to claim 4, further comprising a thin-wall lip in the form of a downward continuation of the horizontal plate.

6. A catch basin according to claim 4, wherein the central portion of at least one of the side walls includes a drain pipe receiving opening which is bordered all the way around by thin-wall plastic material sized to fit within grooved portions of corrugated plastic drain pipe.

7. A plastic catch basin according to claim 6, wherein said catch basin is formed to include a breakout closure for such opening which is formed as a part of the central portion of the side wall and is connected thereto by bridges of the wall material left between circumferentially spaced apart cuts formed in the wall material.

8. A thin-wall, monolithic, structural plastic catch basin comprising four side walls meeting at four corners, a bottom, and a top rim formed to include an upwardly opening grate receiving recess;

each said side wall comprising a main panel portion which slopes inwardly as it extends downwardly;

said corners changing gradually in shape, from a small radius, substantially square configuration at the rim to a large radius rounded configuration at the bottom;

at least one said side wall including a generally upright central portion and a crescent shape transition wall interconnected between the lower part of said central portion and the adjoining part of the main panel portion of the side wall;

with said top rim serving as both a receptacle for a grate and as a structural girth beam which strengthens the top of the catch basin;

with the rounded nature of the corners of the catch basin at the bottom providing a dome shape attended by dome strength at the bottom of the catch basin;

with the corners of the catch basin reinforcing the catch basin vertically against buckling under weight placed on the top of the catch basin;

wherein said side wall central portion includes a drain pipe receiving opening which is bordered all the way around by thin plastic wall material sized to fit within grooved portions of corrugated plastic drain pipe; and corrugated plastic drain pipe connected to said catch basin, comprising a first rib on the inside of said side wall central portion, a second rib on the outside of said side wall central portion, and a groove between said ribs in which the part of said side wall central portion which immediately borders the drain pipe receiving opening is received, said ribs being larger in diameter than said drain pipe receiving opening.

9. A structural plastic catch basin according to claim 8:

in which said top rim extends all the way around said catch basin and comprises a shelf portion which is a horizontal continuation of the side walls of the catch basin and a vertical wall portion which is an upward continuation of said horizontal shelf portion; and further comprising a grate sized to fit within said grate receiving recess, said grate having an outer side portion which is locatable adjacent the vertical wall portion of said rim, and means spaced inwardly from said outer side portion which extends downwardly into the catch basin below said horizontal shelf portion into a bracing position adjacent upper inside surface portions of the side walls of the catch basin.

* * * * *